US005876845A

United States Patent [19]

Magyari et al.

[11] Patent Number: 5,876,845

[45] Date of Patent: Mar. 2, 1999

[54] CUTTER MEMBER FOR MATERIAL REMOVAL TOOL

[75] Inventors: Eugen Magyari, Gams, Switzerland; Walter Ritt, Schnifis, Austria; Peter Jost, Buchs, Switzerland

[73] Assignee: Hilti Aktiengesellschaft, Schaan, Liechtenstein

[21] Appl. No.: 824,078

[22] Filed: Mar. 24, 1997

Related U.S. Application Data

[63] Continuation of Ser. No. 272,495, Jul. 8, 1994, abandoned.

[30] Foreign Application Priority Data

Jul. 16, 1993 [DE] Germany ..... 43 23 895.5

[51] Int. Cl.[6] ..... B28D 1/14

[52] U.S. Cl. ..... 428/325; 428/698; 428/408; 428/457; 407/119; 51/295; 51/307; 51/309

[58] Field of Search ..... 51/307, 309, 295; 428/408, 698, 457, 325; 407/119

[56] References Cited

U.S. PATENT DOCUMENTS

| | | | |
|---|---|---|---|
| 2,411,867 | 12/1946 | Brenner | 428/408 |
| 3,594,141 | 7/1971 | Houston et al. | 51/309 |
| 3,757,878 | 9/1973 | Wilder et al. | 428/408 |
| 3,785,938 | 1/1974 | Sam | 51/309 |
| 3,936,577 | 2/1976 | Christini et al. | 428/426 |
| 4,024,675 | 5/1977 | Naidich et al. | 51/309 |
| 4,142,872 | 3/1979 | Conradi | 51/309 |
| 4,308,035 | 12/1981 | Danilora et al. | 51/298 |
| 4,311,490 | 1/1982 | Bovenkerk et al. | 51/307 |
| 4,555,250 | 11/1985 | Horie et al. | 51/309 |
| 4,618,349 | 10/1986 | Hashimoto et al. | 51/298 |
| 4,655,795 | 4/1987 | Bleecker et al. | 51/309 |
| 4,778,730 | 10/1988 | Zucker | 428/552 |
| 4,844,988 | 7/1989 | Ishizuka et al. | 428/408 |
| 4,916,869 | 4/1990 | Oliver | 51/295 |
| 5,127,197 | 7/1992 | Bruxvoort et al. | 51/309 |
| 5,133,782 | 7/1992 | Wiand | 51/295 |

FOREIGN PATENT DOCUMENTS

| | | |
|---|---|---|
| 169081 | 1/1986 | European Pat. Off. . |
| 57-175775 | 10/1982 | Japan . |
| 967786 | 10/1982 | U.S.S.R. . |

*Primary Examiner*—Archene Turner
*Attorney, Agent, or Firm*—Anderson, Kill & Olick, P.C.

[57] ABSTRACT

A cutting member to be connected to a material removing device such as an annular bit, a drilling bit, a cutting bit, a saw and the like, consists of a binder agent, diamond grains and a small amount of hard material particles. The hard material particles reinforce the binder agent and supports the anchorage of the diamond grains.

4 Claims, No Drawings

CUTTER MEMBER FOR MATERIAL REMOVAL TOOL

This is a continuation application of Ser. No. 08/272,495, Jul. 8, 1994, now abandoned.

BACKGROUND OF THE INVENTION

The present invention is directed to a cutting member for use in material removal tools, such as drills, cutting disks, saws and the like where the cutting member is formed of binder agents, hard material particles and diamond grains.

Material removal tools are used for drilling, cutting and severing of rock and building materials, such as concrete, brick and the like and such tools have cutting edges formed of separate cutting members connected to a carrier in the shape of a hollow cylinder, a disk, a roller and the like. The cutting members consist of binder agents, hard material particles and diamond grains.

A rock drill is disclosed in DE-PS 590 707 which has an annular or core bit formed of sintered hard metal. The hard metal consists of hard metal particles sintered together with the use of a small amount of a binder agent. Diamond grains are embedded in the surface of the annular bit for the purpose of removing material.

The useful life of the rock drill with a core bit or annular bit of the above-mentioned type is determined by the service life of the diamond grains. If the diamond grains are abraded by wear, the bit is no longer able to carry out its material removing function. Further, it should be considered that the core bit formed of sintered hard material provides an extremely hard carrier for the diamond grains, however, it has only a slight toughness or ductility. As a result, all of the blows occurring during the drilling operation are transmitted by the diamond grains, without any damping, to the hard carrier, whereby excessive stresses develop very rapidly, so that the diamond grains fracture prior to their normal wear period with the result that the bit fails prior to the end of its normal useful life.

A hollow drill is disclosed in DE-OS 34 08 092, and has a hollow cylindrical carrier or support with an open end at the drilling end containing cutting members. The cutting members of this known hollow drill consists of a binder with diamond grains embedded in it.

In this hollow drill, the diamond grains are not only present at its surface but also within the entire cutting member comprising the binder. If this drill is used for removing material, the binder is also worn away in addition to the wear of the diamond grains. If a diamond grain has been completely worn away or if it fails, then at the same time some of the binder has been removed, whereby an additional diamond grain is exposed for carrying out the material removing function. The useful life of this known hollow drill ends only after the cutting member is completely worn down. In addition, the binder provides such an elastic carrier or support for the diamond grains that blows developed in the drilling operation can be absorbed without causing overstress and, as a result, does not lead to premature fracture of the diamond grains.

The annular drill bit disclosed in the above-mentioned patent publication has certain advantages as far as useful life is concerned as compared to the bit mentioned at the beginning. These advantages operate within a specific frame of reference and, in particular, are greatly influenced by the material being worked. If such material is a very hard concrete, the wear of the diamond grains and especially of the binder is so great that disadvantages have to be accepted relating to the reduced useful life.

SUMMARY OF THE INVENTION

Therefore, it is primary object of the present invention to provide a cutting member for a material removing tool distinguished by a long service life.

DETAILED DESCRIPTION OF THE INVENTION

In accordance with the present invention, the cutting member is constituted by 6 to 15% by volume of diamond grains, 1 to 3% by volume of hard material particles and 82 to 93% by volume of binder, all based on the total volume of the cutting member.

As far as the cutting operation is concerned, the hard material particles assist in increasing the useful life due to two factors. One factor is of a static nature. The hard material particles, stiffen the binder which is based on cobalt and support the anchoring of the diamond grains. The second factor is of a dynamic nature and involves the protection the hard material particles afford the surface of the binder agent from the erosive reaction of the material being worked on, particularly concrete.

By adding the hard material particles, the abrasion resistance of the binder is preferably increased three or four times. The reinforcement of the binder is precisely controllable depending upon the quantity of hard material particles.

The addition of the hard material particles necessarily results in a slowing-down of the cutting speed. However, since the hard material particles also function as small cutting bodies, a portion of the loss in cutting speed is compensated. The residual "loss" is compensated by adapting the diamond grain concentration. Fewer diamond grains lead to an increase in the cutting speed.

To afford a good support for the diamond grains and a good retentional bond of the hard material particles in the binder agent, the hard material particles have appropriately a grain size in the range of 45 to 90 $\mu$m.

Advantageously, the hard material particles are formed of fused tungsten carbide. Such hard material particles are distinguished by a high hardness and, in addition, afford additional cutting surfaces. Cutting members, in accordance with the present invention, can have a wide range of shapes, with the shape being effectively matched to the carrier or support being used. Depending upon the particular application, the carrier can be a hollow cylinder, a disk, a roller or the like. While hollow cylinders are used particularly in annular tool bits, disks or rollers can also be used if the tool is employed for surface machining or in a cutting tool. The cutting members can be shaped as segments, rings, disks and the like depending on the type of carrier being used.

While a specific embodiment of the invention has been shown and described in detail to illustrate the inventive principles, it will be understood that the invention may be embodied otherwise without departing from said principles.

We claim:

1. Cutting members of a regular shape arranged to be secured to a carrier member for forming drill bits, cutting disks, saws and similar material removing devices are formed of a binder agent, hard material particles and diamond grains acting as cutting elements, wherein the improvement in that the total volume of said cutting members consists of 6 to 15% by volume of diamond grains, 1 to 3% by volume of hard material particles, and 82 to 93% by volume of binder agent.

2. Cutting member, as set forth in claim 1, wherein said hard material particles have a grain size in the range of 45 to 90 $\mu$m.

3. Cutting member, as set forth in claim 1 or 2, wherein said hard material particles consist of fused tungsten carbide.

4. Cutting members of a regular shape arranged to be secured to a carrier member for forming drill bits, cutting disks, saws and similar material removing devices are formed of a binder agent, hard material particles and diamond grains acting as cutting elements, wherein the improvement in that the total volume of said cutting members consists of 6 to 15% by volume of diamond grains, 1 to 3% by volume of hard material particles, and 82 to 93% by volume of binder agent, said hard material particles have a grain size in the range of 45–90 $\mu$m, and said hard material particles consist of fused tungsten carbide.

* * * * *